United States Patent [19]

Severin

[11] 4,008,993

[45] Feb. 22, 1977

[54] METHOD OF PREHEATING THE WALL OF A FURNACE CHANNEL AND ARTICLE FOR GENERATING CIRCULATION OF HEATED AIR FOR PREHEATING THE WALL OF A FURNACE CHANNEL

[75] Inventor: Norman W. Severin, Basking Ridge, N.J.

[73] Assignee: Hotwork, Inc., Lexington, Ky.

[22] Filed: Apr. 7, 1975

[21] Appl. No.: 565,555

[52] U.S. Cl. ..... 432/4; 13/34

[51] Int. Cl.[2] ..... F27D 7/00

[58] Field of Search ..... 432/4; 13/34

[56] References Cited

UNITED STATES PATENTS

| | | | |
|---|---|---|---|
| 1,322,756 | 11/1919 | Cadwell | 432/4 X |
| 2,042,560 | 6/1936 | Stewart | 432/4 |
| 2,175,291 | 10/1939 | Heskett | 432/4 |
| 3,434,704 | 3/1969 | Ward | 432/4 |

*Primary Examiner*—John J. Camby
*Attorney, Agent, or Firm*—Sommers & Sommers

[57] ABSTRACT

A method of preheating the wall of a furnace channel, which channel extends through a wall of the hearth of the furnace at one location therein, through an inductor mounted on the wall of the hearth, and through the wall of the hearth at another location therein and which opens at the opposite ends thereof into the hearth such that a circulatory passage is defined from and to the hearth through the channel, comprising heating the air in the hearth so as to heat the walls thereof, including directing a lowered-temperature flame from a high turn-down burner into the hearth, generating circulation of heated air from the hearth through the channel to heat the wall thereof, and further heating the air in the hearth and channel to further heat the walls thereof, including raising the temperature of the flame from the high turn-down burner and circulating the further heated air through the hearth and channel, so that the temperature of the walls of the furnace and channel is rapidly elevated to furnace and channel operating temperature, and so that substantially all moisture is removed from the wall of the channel prior to introducing molten metal or a metal melting bath into the hearth and channel to prevent spalling or cracking of the channel wall. An article for generating circulation of heated air for preheating the wall of the furnace channel, comprising a tubular element connected at one end to a source of compressed air and including a return at the other end extending in the direction of the one end, which return end is extendable into the furnace and into one end of the channel for directing a stream of compressed air towards such one end of the channel to draw heated air from the hearth through the other end of the channel so as to heat the wall of the channel.

11 Claims, 4 Drawing Figures

METHOD OF PREHEATING THE WALL OF A FURNACE CHANNEL AND ARTICLE FOR GENERATING CIRCULATION OF HEATED AIR FOR PREHEATING THE WALL OF A FURNACE CHANNEL

BACKGROUND OF THE INVENTION

This invention relates generally to the preheating of furnaces. More specifically, this invention relates to a method of preheating the wall of a furnace channel, and an article for generating circulation of heated air for preheating the wall of a furnace channel.

One form of furnace shown as a channel-type induction furnace is used as either a holding furnace for maintaining the temperature of molten metal such as steel, or as a melting furnace for melting ore or scrap into molten metal. Such a channel-type induction furnace includes a hearth or chamber, the walls of which are comprised of heat-resistant material, supportable so as to be rotatable about an axis which extends the length or diameter of such walls, one or more secondary furnaces known as inductors mounted on the underside of the side wall of the hearth, the walls of which are comprised of heat-resistant material, a channel or channels each of which extend through the wall of the hearth at one location therein, through one of the inductors, and through the wall of the hearth at another location therein and opens at the opposite ends thereof into the hearth so as to define a circulatory passage from and to the hearth through the channel, and a plurality of magnetic conductors which extend about each such channel.

In operating such a channel-type induction furnace as a holding furnace for maintaining temperature of molten metal, molten metal is poured into the hearth through a chute or launder mounted in the wall of the hearth, and the magnetic conductors are energized to set up an inductive magnetic field which draws the molten metal through the channel and heats the molten metal as it passes therethrough; such circulation and heating of the molten metal enables precise maintenance and control of the temperature thereof, until such time as further processing is desired, at which time the furnace is rotated about the axis thereof and the molten metal is poured through spouts mounted in the side wall of the hearth into ladles or the like for further processing thereof. In operating such a channel-type induction furnace as a melting furnace for melting ore or scrap into molten metal, a bath fluid is formed in the hearth and brought to melting temperature, whereupon the furnace is charged with ore or scrap through a charging door mounted in the wall of the hearth, and the magnetic conductors are energized to set up an inductive magnetic field which draws the molten ore or scrap through the channel and heats the molten ore or scrap as it passes therethrough. Such circulation and heating of the molten ore or scrap facilitates the melting process, until such time as further processing of the molten metal formed thereby is desired, at which time the furnace is rotated about its axis and the molten metal is poured through spouts mounted in the wall of the hearth into a holding furnace or into ladles or the like for further processing. Channel-type induction furnaces are efficient in operation, and emit a minimum amount of detrimental by-products, such as fumes or combustion by-products, into the atmosphere.

Preheating a channel-type induction furnace to a temperature substantially that of the molten metal or melting bath to be introduced thereinto or formed therein prior to the time of introduction thereof or formation therein is necessary in order to prepare the furnace therefor or to remove moisture in the walls of the furnace so as to prevent spalling and cracking of such walls when such materials are introduced thereinto or formed therein or during the melting or heat maintaining operations and further to prevent adverse effects on the induction field of the magnetic conductors from moisture in the furnace. Preheating should be accomplished rapidly in order to minimize costly furnace down-time.

One method of preheating a channel-type induction furnace previously used comprised applying heat directly to the walls of the hearth. Due to the relatively small size of the channel in the inductor compared with the size of the hearth, the channel proved to be substantially inaccessible to direct flow of heated air from the hearth; therefor, such preheating did not effectively preheat the wall of the channel and subjected such wall to spalling and cracking when liquid metal was poured thereinto. Another method of preheating previously used comprised injecting the flame of a flame-directing lance directly into the channel; however, regulation of the flame at the end of the lance proved to be virtually impossible, especially during initial heating of the channel, as the flame temperature could not be precisely lowered, in that such flame could not be sustained at low temperature heat, with the result that the high temperature flame generated rapid heating of the wall and of moisture in the wall of the channel resulting in spalling and cracking thereof. Other methods of preheating previously used included energizing the magnetic conductors in the inductor, or lining the channel with a steel liner energized with and connected to the magnetic conductors, so as to heat the wall of the channel; however, it was virtually impossible to precisely control the current and subsequent initial heat generated by using such methods, resulting in rapid expansion of the wall and of moisture in the wall of the channel and spalling and cracking thereof.

Summary of the Invention

In view of the above, it is among the objects of this invention to provide a method of preheating the wall of a channel-type induction furnace so as to rapidly achieve operating temperature in a dry furnace, or, in an oven in which moisture is present, to remove such moisture therefrom in an even and thorough manner, to prevent spalling or cracking thereof upon introducing moltel metal or ore or scrap thereinto, and to rapidly preheat the channel and hearth walls to operating temperature so as to minimize costly furnace down-time.

The above objects and others are achieved in this invention by means of a method of preheating the wall of a furnace channel, which channel extends through a wall of the hearth of the furnace at one location therein, through an inductor mounted on the wall of the hearth, and through the wall of the hearth at another location therein and which opens at the opposite ends thereof into the hearth such that a circulatory passage is defined from and to the hearth through the channel, comprising heating the air in the hearth so as to heat the walls thereof, including directing a lowered-temperature flame from a high turn-down burner into the hearth, generating circulation of heated air from the hearth through the channel to heat the wall thereof, and further heating the air in the hearth and channel to further heat the walls thereof, including raising the temperature of the flame from the high turn-down burner and circulating the further heated air through the hearth and channel, so that the temperature of the walls of the furnace and channel is rapidly elevated to furnace and channel operating temperature, and so that substantially all moisture is removed from the wall of the channel prior to introducing molten metal or a metal melting bath into the hearth and channel to prevent spalling or cracking of the channel wall. The above objects and others are further achieved in this invention by means of an article for generating circulation of heated air for preheating the wall of the furnace channel comprising a tubular element connected at one end to a source of compresed air and including a return at the other end extending in the direction of the one end which return end is extendable into the furnace and into one end of the channel for directing a stream of compressed air towards such one end of the channel to draw heated air from the hearth through the other end of the channel so as to heat the wall of the channel.

DESCRIPTION OF THE DRAWINGS

This invention is illustrated, by way of example, in the accompanying drawings, in which.

DESCRIPTION OF THE PREFERRED EMBODIMENTS

Figure 1:
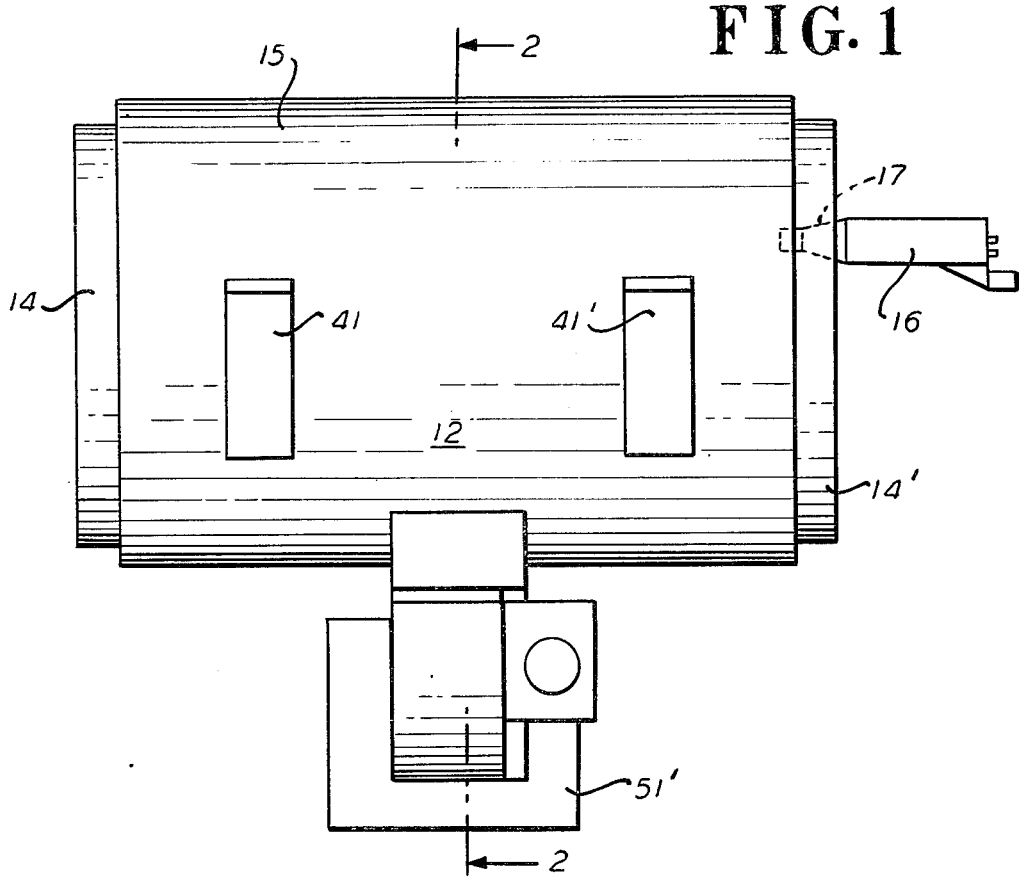
FIG. 1 is a side elevational view of a channel-type induction furnace with a high turn-down burner extending into the hearth thereof.
Figure 2:
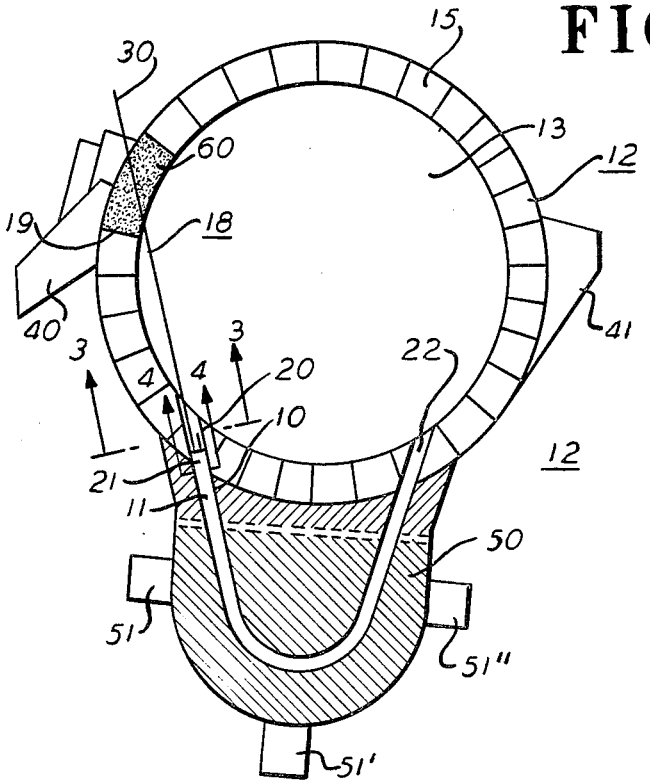
FIG. 2 is an elevational cross-sectional view taken at line 2—2 of FIG. 1 in which the circulation generating article is extended into the hearth of the furnace.
Figure 3:
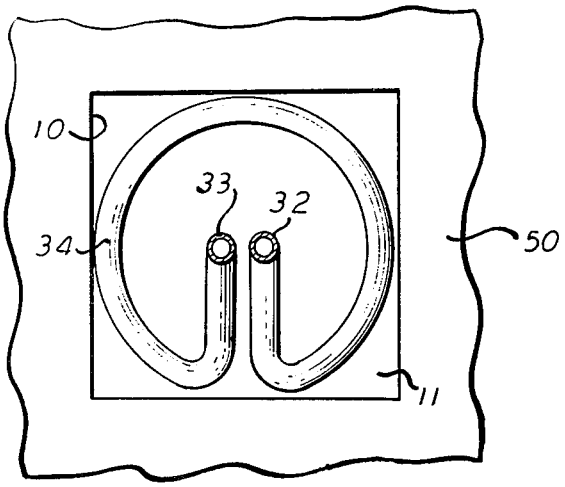
FIG. 3 is a fragmentary cross-sectional elevational view taken at line 3—3 of FIG. 2.
Figure 4:
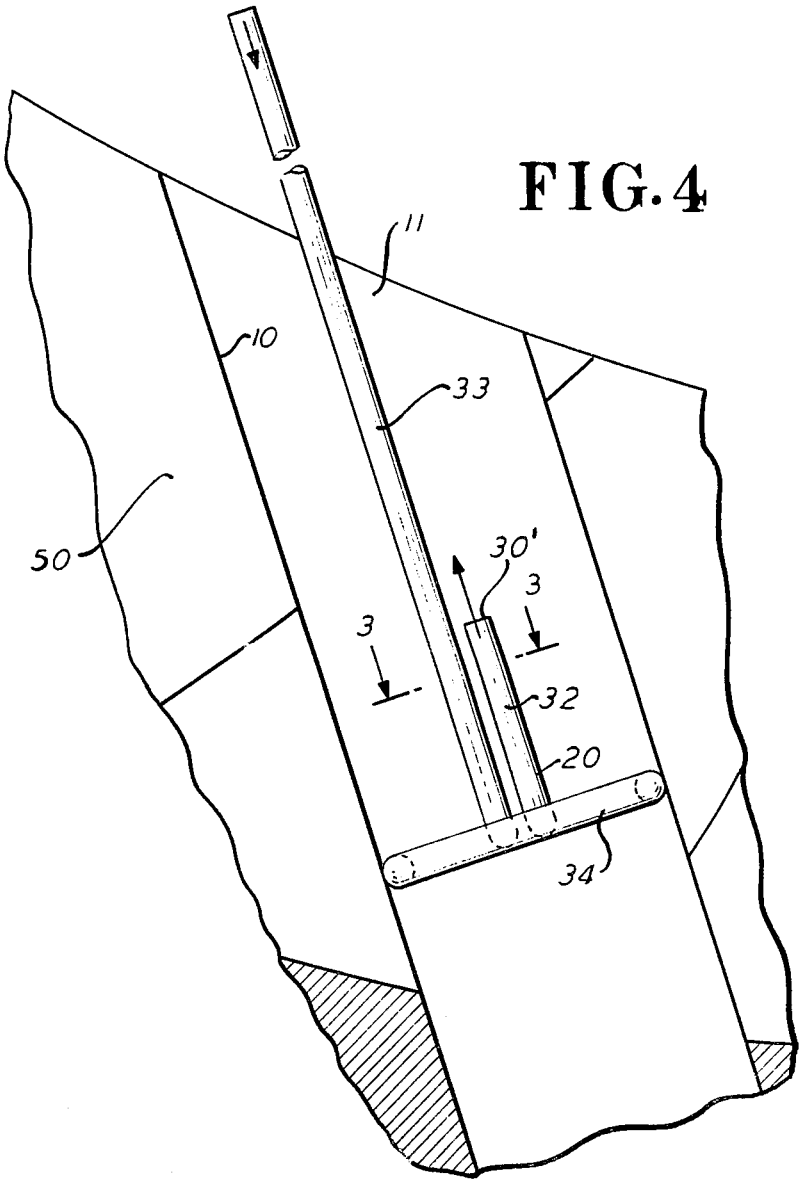
FIG. 4 is a fragmentary partly-sectional elevational view of section 4—4 in FIG. 2.

In the preferred embodiment of the invention as illustrated in FIG. 1–4, the method of preheating the wall 10 of a channel 11 of a channel-type induction furnace 12 comprises, for example, heating the air in the hearth 13 of the furnace 12 so as to heat the end walls 14, 14' and side wall 15 thereof, including directing a lowered-temperature flame from a high turn-down burner 16 into the hearth 13 through the opening 17 in the end wall 14' of the hearth 13, generating circulation of heated air from the hearth 13 through the channel 11 to heat the wall 10 thereof by extending a tubular element 18 through an opening 19 in the side wall 15 of the hearth 13 so that a return portion 20 of the tubular element 18 extends into one end 21 of the channel 11 to direct a stream of compressed air A towards such one end 21 of the channel 11 so as to create a pressure drop at such one end 21 of the channel 11 to pull heated air from the hearth 13 through the other end 22 of the channel 11 and through the channel 11, and further heating the air in the hearth 13 and channel 11 to further heat the end walls 14, 14' and side wall 15 of the hearth and the wall 10 of the channel 11, so that the temperature of the walls of the furnace and channel is rapidly elevated to furnace and channel operating temperature, and so that substantially all moisture is removed from the wall 10 of the channel 11, which prevents spalling or cracking of the wall 10 of the channel 11 upon introducing molten metal or a metal melting bath thereinto.

In the further preferred embodiment of the invention as illustrated in FIGS. 1–4, the article for generating circulation of heated air for preheating the wall 10 of the channel in the furnace 12 comprises, for example, the tubular element 18 connectable at one end 30 to a supply of compressed air or gas or the like, and including the return portion 20 at the other end thereof which comprises a return 32 which extends parallel to the main body 33 of the tubular element 18 in the direction of the one end 30 thereof, and a loop 34 which extends perpendicular to the main body 33 of the tubular element 18 intermediate the return 32 and the main body 33. The furnace 12, into which the tubular element 18 is extendable, comprises the end walls 14, 14' and side wall 15 comprised of heat-resistant material defining the hearth 13, having the opening 17 in the end wall 14', the opening 19 in the side wall 15, a chute 40 mounted in the side wall 15 which communicates with opening 19, spouts 41 and 41' mounted on the side walls 15, an inductor 50 mounted on the underside of the side wall 15 and comprised of heat-resistant material, the channel 11 which extends at one end thereof through the side wall 15 at one location therein, through the inductor 50, and at the other end 22 thereof through the side wall 15 at another location therein, such that a circulatory passage is defined from and to the hearth 13 through the channel 11, and magnetic conductors 51, 51', 51'' which extend about the channel 11 and through the inductor 50. The burner 16, extendable into the hearth 13 through the opening 17 in the end wall 14', is of the high turn-down type requiring a minimum amount of gas to sustain the flame, and capable of sustaining the flame at a low flame temperature. In operation, the tubular element 18 is extended through the opening 19 in the side wall 15 of the furnace 12, such that the loop 34 of the return portion 20 extends into one end 21 of the channel 11 and bears against the wall 10 of the channel 11 so as to support the return portion 20 therein, which opening 19 is then sealed with insulating material 60, and compressed air from the supply is directed through the main body 33, the loop 34, the return 32 of the tubular element 18, and towards the one end 21 of the channel 11, whereupon a pressure drop is created at such one end 21 of the channel 11 and air from the hearth 13, heated by the lowered temperature flame from the high turn-down burner 16, is drawn from the other end 22 of the channel 11 through the channel 11, and such heated air circulates through the channel 11 so as to preheat the wall 10 of the channel 11 to substantially the temperature of the molten steel or melting bath to be introduced thereinto in an even, thorough and rapid manner so as to prevent spalling and cracking of the wall 11 and to minimize costly furnace down-time.

While this invention has been particularly set forth in terms of specific embodiments thereof, it will be understood in view of the present disclosure that numerous variations upon the invention are enabled to those skilled in the art, which variations nevertheless are within the scope of the present teaching. Accordingly, the invention is to be broadly construed and limited only by the scope and spirit of the claims appended hereto.

I claim:

1. A method of preheating the wall of a channel which extends in a furnace through a wall of the hearth of the furnace at one location therein, through an inductor mounted on the wall of the hearth, and through the wall of the hearth at another location therein and which opens at the opposite ends thereof into the hearth through the channel, comprising:

a. heating the air in the hearth so as to heat the walls thereof;

b. generating circulation of heated air by creating a pressure drop at one end of the channel to draw heated air from the hearth through the channel to heat the wall thereof; and c. further heating the air in the hearth and channel to further heat the walls thereof.

2. A preheating method as recited in claim 1, in which the step of heating the air in the hearth includes directing a lowered-temperature flame from a high turn-down burner into the hearth, and in which the step of further heating the air in the hearth and channel includes raising the temperature of the flame from the high turn-down burner and circulating the further heated air through the hearth and channel.

3. A preheating method as recited in claim 1, in which the step of generating circulation of heated air includes extending one end of a tubular element through the wall of the hearth of the furnace into one end of the channel.

4. A preheating method as recited in claim 1, in which the step of generating circulation of heated air includes extending the end of a tubular element which includes a return portion through the wall of the hearth of the furnace into one end of the channel, and connecting a pressure source to the other end of the tubular element.

5. A preheating method as recited in claim 3, in which the step of generating circulation of heated air includes sealing the openings in the wall of the hearth, including the opening through which the tubular element is extended, with insulating material.

6. A preheating method as recited in claim 4, in which the step of generating circulation of heated air further includes positioning the one end of the tubular element which includes a return portion in the one end of the channel so that a loop portion of the return portion of the tubular element bears against the wall of the channel.

7. A preheating method as recited in claim 4, in which the step of generating circulation of heated air includes sealing the openings in the wall of the hearth including the opening through which the tubular element is extended with insulating material.

8. An article for generating circulation of heated air from the hearth of a furnace through a channel which extends through the wall of the hearth at one location therein, through an inductor mounted on the furnace, and through the wall of the hearth at another location therein, which channel opens at the opposite ends thereof into the hearth such that a circulatory passage is defined from and to the hearth through the channel, which comprises a tubular element which includes a return portion at one end which extends in the direction of the opposite end.

9. A circulation-generating article as recited in claim 8, in which the return portion includes a loop which extends transverse to the main body of the tubular element intermediate the return and the main body.

10. A circulation-generating article as recited in claim 8, in which the return portion includes a return which extends parallel to the main body of the tubular element.

11. A circulation-generating article as recited in claim 9, in which the loop extends perpendicular to the main body of the tubular element.

* * * * *